US006305209B1

(12) United States Patent
Suzuki et al.

(10) Patent No.: US 6,305,209 B1
(45) Date of Patent: Oct. 23, 2001

(54) WORKPIECE BLANKING APPARATUS

(75) Inventors: Tetsuo Suzuki; Makoto Kobayashi, both of Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,769

(22) Filed: Mar. 30, 2000

(30) Foreign Application Priority Data

Mar. 31, 1999 (JP) ..... 11-092127
Oct. 26, 1999 (JP) ..... 11-303603

(51) Int. Cl.[7] ..... B21D 28/02; B21D 45/04
(52) U.S. Cl. ..... 72/328; 72/326; 72/345; 83/127
(58) Field of Search ..... 72/328, 326, 344, 72/345, 355.2, 355.6, 427; 83/125, 127, 128, 129, 131, 389

(56) References Cited

U.S. PATENT DOCUMENTS 1,895,401 * 1/1933 Simonsen ..... 72/345
4,206,628 * 6/1980 Miller ..... 72/355.6
4,951,537 * 8/1990 Bennett ..... 83/128
5,802,944 9/1998 Bianchi et al. ..... 83/639.1

FOREIGN PATENT DOCUMENTS

24248 * of 1912 (GB) ..... 72/344
514430 * 2/1957 (IT) ..... 72/345
5-945036 3/1984 (JP) .
215237 * 12/1984 (JP) ..... 72/344
166836 * 6/1989 (JP) ..... 72/344
585909 * 12/1977 (SU) ..... 72/345
963677 * 2/1983 (SU) ..... 72/344

* cited by examiner

*Primary Examiner*—Daniel C. Crane
(74) *Attorney, Agent, or Firm*—Birch, Stewart, Kolasch & Birch, LLP

(57) ABSTRACT

A workpiece blanking apparatus has a die, a pad for holding a plate of metal on the die, a blanking punch for depressing the plate on the die downwardly of the die to blank a workpiece out of the plate, and a counterpunch vertically movably disposed in the die in confronting relationship to the blanking punch and movable downwardly with the workpiece blanked by the blanking punch. A counterpunch urging device normally urges the counterpunch upwardly, and a holding mechanism holds the counterpunch in a lowered position after the workpiece is blanked by the blanking punch until the blanking punch is spaced from the workpiece, the pad is spaced from the plate, and the blanking punch and the pad are lifted to a predetermined position. The holding mechanism releases the counterpunch in the lowered position and allows the counterpunch to displace the workpiece out of the die when the blanking punch and the pad are lifted to the predetermined position.

13 Claims, 9 Drawing Sheets

WORKPIECE BLANKING APPARATUS

BACKGROUND OF THE INVENTION

1. Field of the Invention

The present invention relates to a workpiece blanking apparatus for blanking a workpiece of predetermined shape out of a metal plate.

2. Description of the Related Art

Known workpiece blanking apparatus comprise a vertically movable upper die assembly, a blanking punch vertically movable with respect to the upper die assembly and having a shape corresponding to the shape of a workpiece to be blanked, and a lower die assembly with a die fixedly mounted thereon. When the blanking punch is lowered toward a metal plate placed on the die, a desired workpiece is blanked out of the metal plate.

Specifically, a pad biased to move downwardly by a biasing means is disposed around the blanking punch. The pad has a lower end which is at the same height as the lower end of the blanking punch or projects slightly downwardly from the lower end of the blanking punch when the upper die assembly is in an elevated position. When the upper die assembly is lowered, the pad descends with the blanking punch and engages the metal plate on the die simultaneously with or slightly earlier than the blanking punch, thus resiliently holding the metal plate on the die. The blanking punch is continuously lowered into the metal plate to blank the workpiece out of the metal plate and depress the blanked workpiece.

The die on the lower die assembly has a vertically movable counterpunch disposed in confronting relationship to the blanking punch and normally biased to move upwardly. The counterpunch has an upper end which lies at the same height as the die when the upper die assembly is in the elevated position, i.e., before the workpiece is blanked out of the metal plate. As the workpiece is depressed by the blanking punch, the counterpunch is lowered while being pressed against the lower surface of the workpiece. After the workpiece is blanked, the blanking punch is lifted to a predetermined position, e.g., a position above the die, the pad is released from the downward push and displaced upwardly away from the metal plate.

Since the counterpunch is biased upwardly, when the blanking punch is lifted, the workpiece is raised to the position of the upper surface of the die by the counterpunch. Therefore, before the pad is spaced from the metal plate, the workpiece is pushed back to the metal plate, and tends to be deformed because its outer edge contacts the severed edge of the metal plate. As a result, the blanked workpiece is liable to have an inaccurate shape.

SUMMARY OF THE INVENTION

It is therefore an object of the present invention to provide a workpiece blanking apparatus which is capable of blanking a workpiece highly accurately out of a metal plate.

According to the present invention, a workpiece blanking apparatus includes a die, a pad for holding a plate of metal on said die, a blanking punch for depressing the plate on said die downwardly of the die to blank a workpiece out of the plate, a counterpunch vertically movably disposed in said die in confronting relationship to said blanking punch and movable downwardly with the workpiece blanked by said blanking punch, and counterpunch urging means for normally urging said counterpunch upwardly. The workpiece blanking apparatus also has holding means for holding said counterpunch in a lowered position after the workpiece is blanked by said blanking punch until said blanking punch is spaced from the workpiece, said pad is spaced from the plate, and said blanking punch and said pad are lifted to a predetermined position, and for releasing said counterpunch in said lowered position and allowing said counterpunch to displace said workpiece out of said die when said blanking punch and said pad are lifted to said predetermined position.

The workpiece blanking apparatus operates as follows: The pad is lowered to press the plate against the die. Then, the blanking punch is lowered to blank a workpiece of desired shape out of the plate. When the blanking punch is lowered, the counterpunch is lowered with the workpiece sandwiched between the counterpunch and the blanking punch. After the blanking punch reaches a lowered position, blanking the workpiece, the blanking punch is lifted and the pad is lifted. At this time, the holding means holds the counterpunch at rest in the lowered position.

Since the counterpunch is not lifted even when the blanking punch is lifted, the blanked workpiece is not pushed back to the plate pressed against the die by the pad. The blanked workpiece is thus prevented from contacting and being damaged by the plate and can have a highly accurate shape.

When the blanking punch is spaced from the workpiece, the pad is spaced from the plate, and the blanking punch and the pad are lifted to the predetermined position, the holding means releases the counterpunch in the lowered position. The counterpunch now starts to ascend under the bias of the counterpunch urging means. As a result, the blanked workpiece is lifted by the counterpunch, and hence can smoothly be displaced out of the die while maintaining the highly accurate shape.

According to a first aspect of the present invention, the holding means has a pusher vertically movably disposed below said die for transmitting a biasing force from said counterpunch urging means to said counterpunch. A concave follower is integrally mounted on an upper surface of said pusher, and a slider is disposed for movement along the upper surface of said pusher in a horizontal direction transverse to said counterpunch. A cam integrally projects from a lower surface of said slider and movable into and out of engagement with said follower, for preventing said pusher from ascending upon movement into engagement with said follower and allowing said pusher to ascend upon movement out of engagement with said follower. The holding means also has slider driving means for moving said slider horizontally in a direction to bring said cam out of engagement with said follower when said pusher is lowered in response to downward movement of said counterpunch depressed by said blanking punch, and for moving said slider horizontally in a direction to bring said cam into engagement with said follower when said blanking punch and said pad are lifted to said predetermined position.

With this arrangement, after the workpiece is blanked and until the blanking punch and the pad are lifted to the predetermined position, the cam and the follower are held out of engagement with each other, preventing the pusher and the counterpunch from being elevated. After the blanking punch and the pad are lifted to the predetermined position, the cam and the follower are brought into engagement with each other, and the counterpunch is lifted to push the workpiece above the die. Therefore, the workpiece is not pushed back toward the plate, and hence the outer edge of the workpiece is prevented from contacting and being damaged by the plate. As a result, the workpiece is blanked to a highly accurate shape.

In the first aspect of the present invention, said concave follower has a horizontal upper surface for engaging said cam when said cam is out of engagement with said follower and a first slanted surface inclined continuously obliquely downwardly from said horizontal upper surface, for guiding said cam to slide from said horizontal upper surface. The concave follower also has a horizontal lower surface contiguous to said first slanted surface for allowing said cam to slide horizontally thereon, and a second slanted surface inclined continuously obliquely upwardly from said horizontal lower surface in confronting relationship to said first slanted surface at a progressively increasing angle, for limiting sliding movement of said cam from said horizontal lower surface.

When the cam and the follower are brought into engagement with each other by movement of the slider, the cam slides smoothly from the horizontal upper surface of the follower continuously along the first slanted surface to the lower surface. In this manner, wear on contacting surfaces of the cam and the follower is reduced. Then, the cam slides along the lower surface of the follower. At this time, an upward biasing force of the counterpunch urging means is applied to the pusher. Therefore, the lower surface of the follower is pressed against the cam, reducing the speed at which the cam slides. Thereafter, the cam is brought into sliding contact with the second slanted surface, and stopped due to increased frictional engagement with the second slanted surface that is inclined at a sharp angle.

Since any shocks produced when the cam and the follower are brought into sliding engagement with each other are reduced, the workpiece blanking apparatus is subject to reduced wear and damage owing to those shocks, and has increased durability.

Preferably, the first slanted surface has an angle progressively increasing downwardly from an upper end thereof which is contiguous to said horizontal upper surface, and progressively decreasing downwardly toward a lower end thereof so as to allow the first slanted surface to blend into said horizontal lower surface.

Inasmuch as the angle of the first slanted surface progressively increases downwardly from the upper end thereof which is contiguous to said horizontal upper surface, when the cam and the follower are brought into engagement with each other, the cam is gradually accelerated as it slides from the upper end of the first slanted surface to its middle region. When the cam and the follower are brought out of engagement with each other, the cam slides gradually over the upper end of the first slanted surface onto the upper surface and then stops on the upper surface, so that wear on the contacting surfaces of the cam and the follower at the upper end of the first slanted surface is reliably reduced. Furthermore, because the angle of the first slanted surface then progressively decreases downwardly toward the lower end thereof, when the cam and the follower are brought into engagement with each other, the cam is gradually decelerated as it slides from the middle region of the first slanted surface to the lower end thereof. When the cam and the follower are brought out of engagement with each other, the cam slides smoothly at the lower end of the first slanted surface. Accordingly, wear on the contacting surfaces of the cam and the follower at the lower end of the first slanted surface is reliably reduced.

According to a second aspect of the present invention, said holding means has a pusher vertically movably disposed below said die for transmitting a biasing force from said counterpunch urging means to said counterpunch. A cam is tiltably disposed between said pusher and said die, for preventing said pusher from ascending upon angular movement into an erected position and allowing said pusher to ascend upon angular movement into a tilted position. The holding means also has cam driving means for angularly moving said cam into the erected position when said pusher is lowered in response to downward movement of said counterpunch depressed by said blanking punch, and for angularly moving said cam into the tilted position when said blanking punch and said pad are lifted to said predetermined position.

With the above arrangement, after the workpiece is blanked, the cam is in the erected position until the blanking punch and said pad are lifted to said predetermined position, preventing the pusher and the counterpunch from being lifted. After the blanking punch and said pad are lifted to said predetermined position, the cam is brought into the tilted position, and the counterpunch is lifted to push the workpiece above die. Because the workpiece is not limited toward the plate while the plate is being pressed against the die by the pad, the workpiece is prevented from contacting the plate from which it has been blanked.

In the second aspect of the present invention, said holding means comprises a slider disposed for movement along an upper surface of said pusher in a horizontal direction transverse to said counterpunch. The cam driving means horizontally moves said slider in a direction to bring said cam into the erected position when said pusher is lowered in response to downward movement of said counterpunch depressed by said blanking punch, and horizontally moves said slider in a direction to bring said cam into the tilted position when said blanking punch and said pad are lifted to said predetermined position.

When the cam is in the tilted position and pressed by the pusher, the cam remains in the tilted position between the slider and the pusher. When the pusher is lowered by downward movement of the counterpunch, the cam is released from the push of the pusher, and can be turned. When the slider is horizontally moved by the cam driving means, the cam can smoothly be brought into the erected position by the movement of the slider.

The cam in the erected position prevents the pusher from being lifted, and at the same time is pressed by the pusher under the bias of the counterpunch urging means. The cam is now maintained in the erected position, holding the counterpunch in the lowered position.

When the blanking punch and the pad are lifted to the predetermined position, the slider is horizontally moved in the direction to tilt the cam. The pusher is now allowed to ascend, and the biasing force from the counterpunch urging means is transmitted via the pusher to the counterpunch. Therefore, the counterpunch is elevated to push the workpiece smoothly above the die.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 5(*b*) is an enlarged fragmentary cross-sectional view showing a stage of operation of the cam and the follower shown in FIG. 5(*a*);

FIG. 5(*c*) is an enlarged fragmentary cross-sectional view showing a stage of operation, next to the stage of operation shown in FIG. 5(*b*), of the cam and the follower;

FIG. 5(*d*) is an enlarged fragmentary cross-sectional view showing a stage of operation, next to the stage of operation shown in FIG. 5(*c*), of the cam and the follower;

FIG. 5(*e*) is an enlarged fragmentary cross-sectional view showing a stage of operation, next to the stage of operation shown in FIG. 5(*d*), of the cam and the follower;

DETAILED DESCRIPTION OF THE PREFERRED EMBODIMENTS

For blanking a workpiece of predetermined shape out of a blank metal plate, it is customary to cut the workpiece from the blank metal plate such that the workpiece remains partly connected to the blank metal plate by a joint, and thereafter the joint is cut off to separate the workpiece completely from the blank metal plate. A workpiece blanking apparatus according to the present invention performs such a blanking operation, i.e., blanks a workpiece out of a blank metal plate in a manner to remain partly joined to the blank metal plate.

Figure 1:
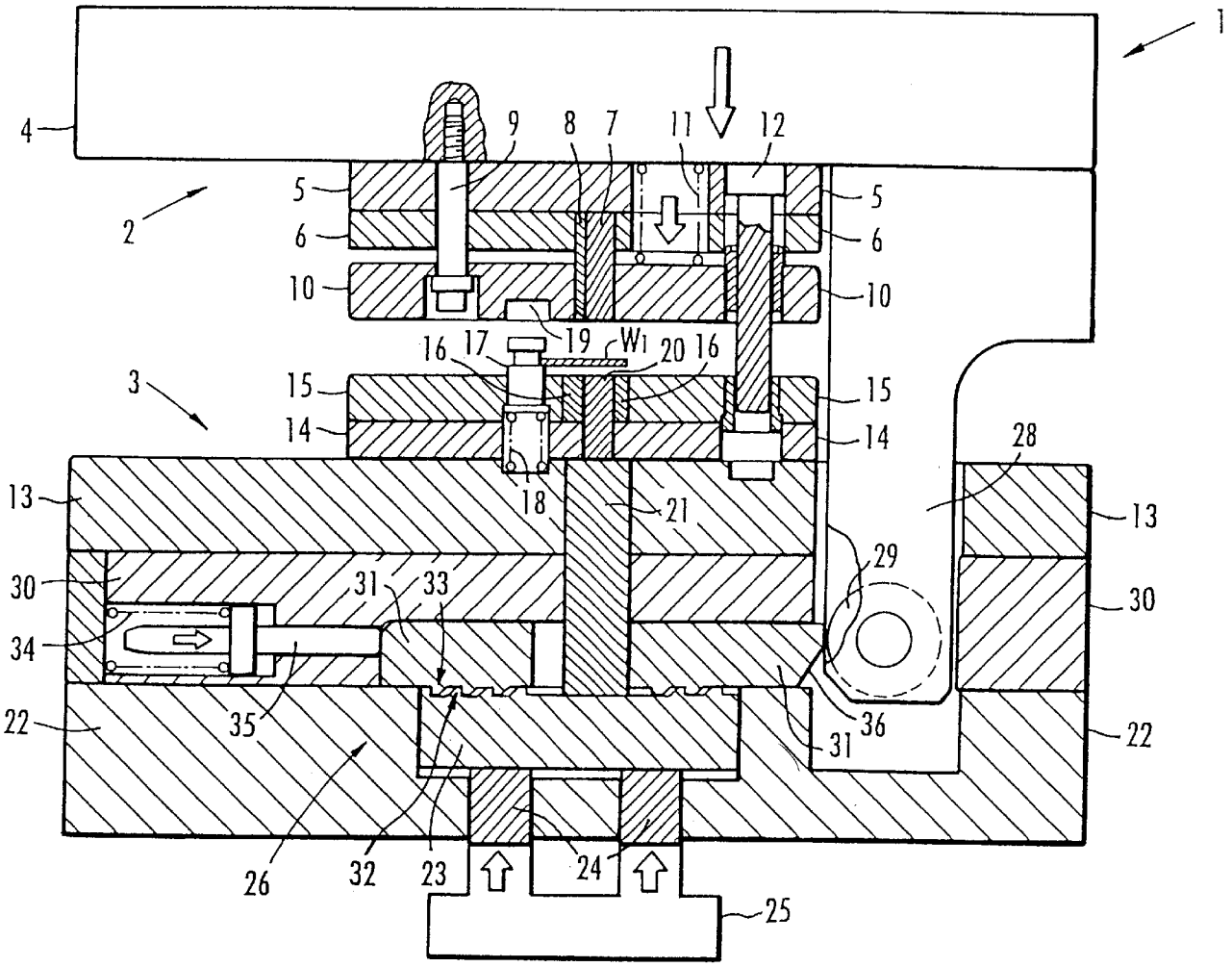
FIG. 1 is a vertical cross-sectional view of a workpiece blanking apparatus according to a first embodiment of the present invention.

A workpiece blanking apparatus according to a first embodiment of the present invention will be described below. As shown in FIG. 1, the workpiece blanking apparatus, generally denoted by 1, according to the first embodiment comprises an upper die assembly 2 vertically movable by a lifting/lowering cylinder (not shown), and a lower die assembly 3 fixedly mounted on a base (not shown).

The upper die assembly 2 comprises an upper die set 4 coupled to the lifting/lowering cylinder, and a punch plate 6 fixed to the upper die set 4 with a backing plate 5 interposed therebetween. To the punch plate 6, there are fixed a blanking punch 7 for blanking a workpiece W2 (see FIG. 4) of predetermined shape out of a plate W1 of metal, and a joint forming punch 8 for keeping the workpiece W2 joined to the plate W1 when the workpiece W2 is blanked out of the plate W1. A pad 10 is vertically movably connected to the upper die set 4 by a retainer 9. The pad 10 is normally urged to move downwardly by a spring 11 acting between the pad 10 and the upper die set 4. A guide post 12 extends downwardly from the upper die set 4 through the backing plate 5, the punch plate 6, and the pad 10 toward the lower die assembly 3 for guiding the upper die assembly 2 to descend accurately toward the lower die assembly 3.

The lower die assembly 3 comprises a lower die set 13 and a die plate 15 fixed to the lower die set 13 with a backing plate 14 interposed therebetween. A die 16 is fixedly mounted in the die plate 15 in vertically confronting relationship to the blanking punch 7. When the blanking punch 7 is lowered, the blanking punch 7 is inserted into the die 16 while depressing the workpiece W2 as it is blanked out of the plate W1. The plate W1 is vertically movably supported by a guide lifter 17 which is mounted on the lower die set 13 and projects vertically through the backing plate 14 and the die plate 15. The guide lifter 17 is vertically movable and normally urged to move upwardly by a spring 18. The guide lifter 17 can be pressed downwardly by a presser 19 on the pad 10. When the pad 10 is lowered, the guide lifter 17 is retracted downwardly to place the plate W1 on the die 16. When the die 10 is lifted, the guide lifter 17 is advanced upwardly to space the plate W1 from the die 16.

A vertically slidable counterpunch 20 is disposed in the die 16 in vertical alignment with the blanking punch 7. The counterpunch 20 has a lower end connected to the upper end of a first pressure pin 21 which extends downwardly through the lower die set 13. The first pressure pin 21 has a lower end held against a pusher 23 which is vertically movably supported in a set plate 22. The pusher 23 is normally urged to move upwardly by a pair of second pressure pins 24 connected to a counterpunch urging means 25 such as a spring, a cylinder or the like (not shown). The biasing force of the counterpunch urging means 25 is transmitted from the pusher 23 to the counterpunch 20 by the first pressure pin 21.

Figure 3:
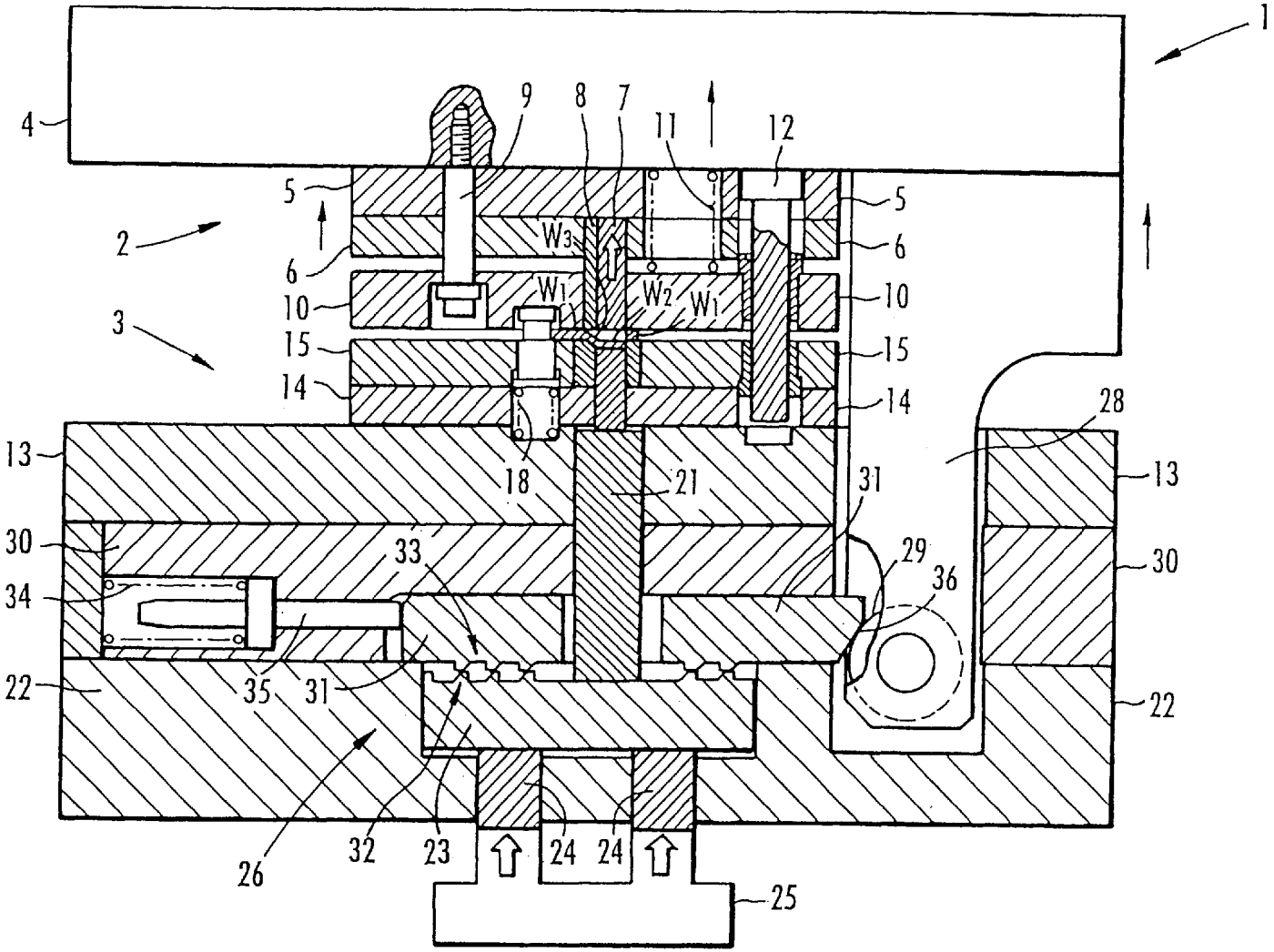
FIG. 3 is a vertical cross-sectional view showing a phase of operation, next to the stage of operation shown in FIG. 2, of the workpiece blanking apparatus.

The lower die assembly 3 has a holding means 26 for holding the counterpunch 20 in a predetermined lowered position after the workpiece W2 is blanked out of the plate W1 by the blanking punch 7 until the blanking punch 7 is spaced from the workpiece W2 and elevated to a predetermined position, as shown in FIG. 3.

The holding means 26 of the workpiece blanking apparatus 1 according to the first embodiment will be described in detail below.

As shown in FIG. 1, the holding means 26 comprises the pusher 23 and a slider 31 which is horizontally movably housed in a spacer plate 30 that is fixedly disposed between the lower die set 13 and the set plate 22. The pusher 23 has a follower 32 of wavy cross section on its upper surface, and the slider 31 has a cam 33 of wavy cross section on its lower surface which is engageable with the follower 32.

The slider 31 is normally urged by a pusher pin 35 biased by a spring 34 positioned on one side (left side in FIG. 1) of the slider 31, to move away from the spring 34 (to the right in FIG. 1). The slider 31 has an inclined surface 36 on an end (right end in FIG. 1) thereof remote from the pusher pin 35. The inclined surface 36 is held against a cam roller 29 rotatably supported on the lower end of a driver 28 extending downwardly from the upper die set 4 for vertical movement in unison with the upper die set 4. The spring 34, the pusher pin 35, the driver 28, and the cam roller 29 jointly make up a slider driving means.

Figure 5:
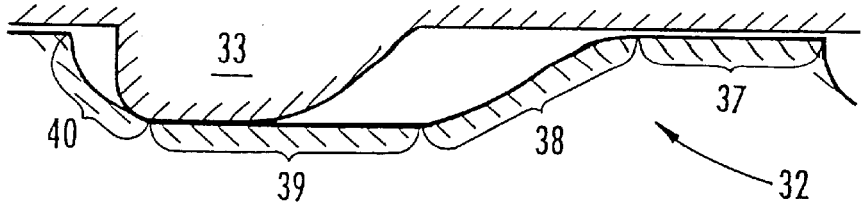
FIG. 5(*a*) is an enlarged fragmentary cross-sectional view of a cam and a follower in the workpiece blanking apparatus according to the first embodiment of the present invention.
Figure 5:
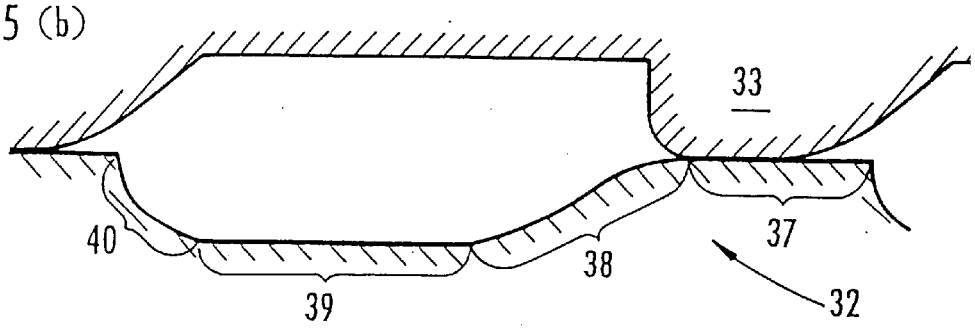
Figure 5:
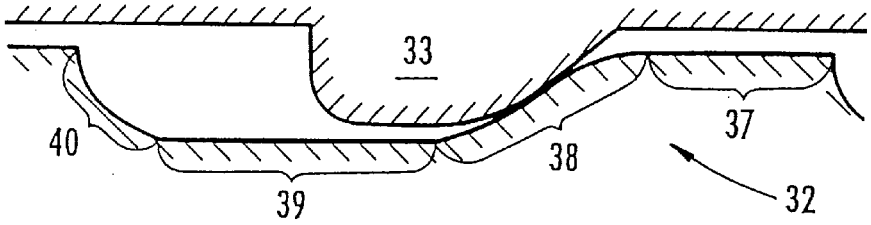
Figure 5:
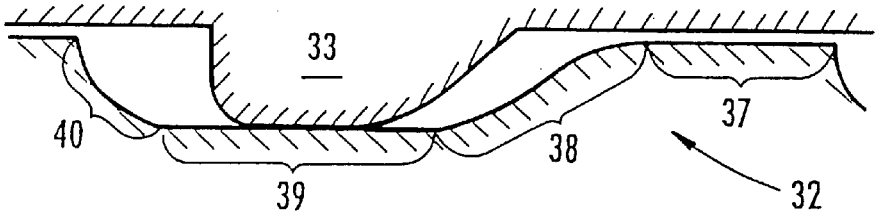
Figure 5:
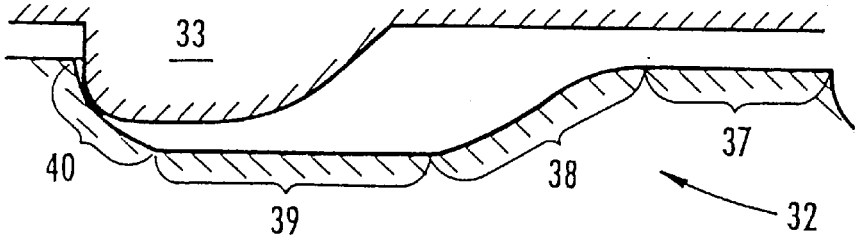

As shown in FIG. 5(*a*), the follower 32 has a horizontal upper surface 37, a first slanted surface 38 extending obliquely downwardly from the upper surface 37 at an angle which progressively increases and then decreases in the direction away from the upper surface 37, a lower surface 39 extending smoothly from the first slanted surface 38 and lying horizontally at a level lower than the slanted surface 38, and a second slanted surface 40 extending obliquely upwardly from the lower surface 39 at an angle which progressively increases in the direction away from the lower surface 39. Specifically, the first slanted surface 38 is gradually curved downwardly from its upper end toward middle region at the progressively increasing angle, then gradually curved toward the horizontal plane from its middle region to lower end, and smoothly blends into the lower surface 39. The follower 32 has a horizontal succession of the above configuration. The cam 33 projects downwardly from the lower surface of the slider 31, and has a substantially trapezoidal cross-sectional shape with round lower corners, as viewed in side elevation. The cam 33 has a horizontal succession of the above configuration.

A process of blanking the workpiece W2 out of the plate W1 with the workpiece blanking apparatus 1 will be described below with reference to FIGS. 1–4 and 5(*a*) through 5(*e*). As shown in FIG. 1, the plate W1 is placed between the blanking punch 7 and the die 16 and supported at one side by the guide lifter 17. Then, the upper die assembly 2 starts being lowered toward the lower die assembly 3. At this time, as shown in FIG. 5(*a*), the cam 33 is at rest and held against the lower surface 39 of the follower 32, i.e., the cam 33 and the follower 32 are held in engagement with each other.

Figure 2:
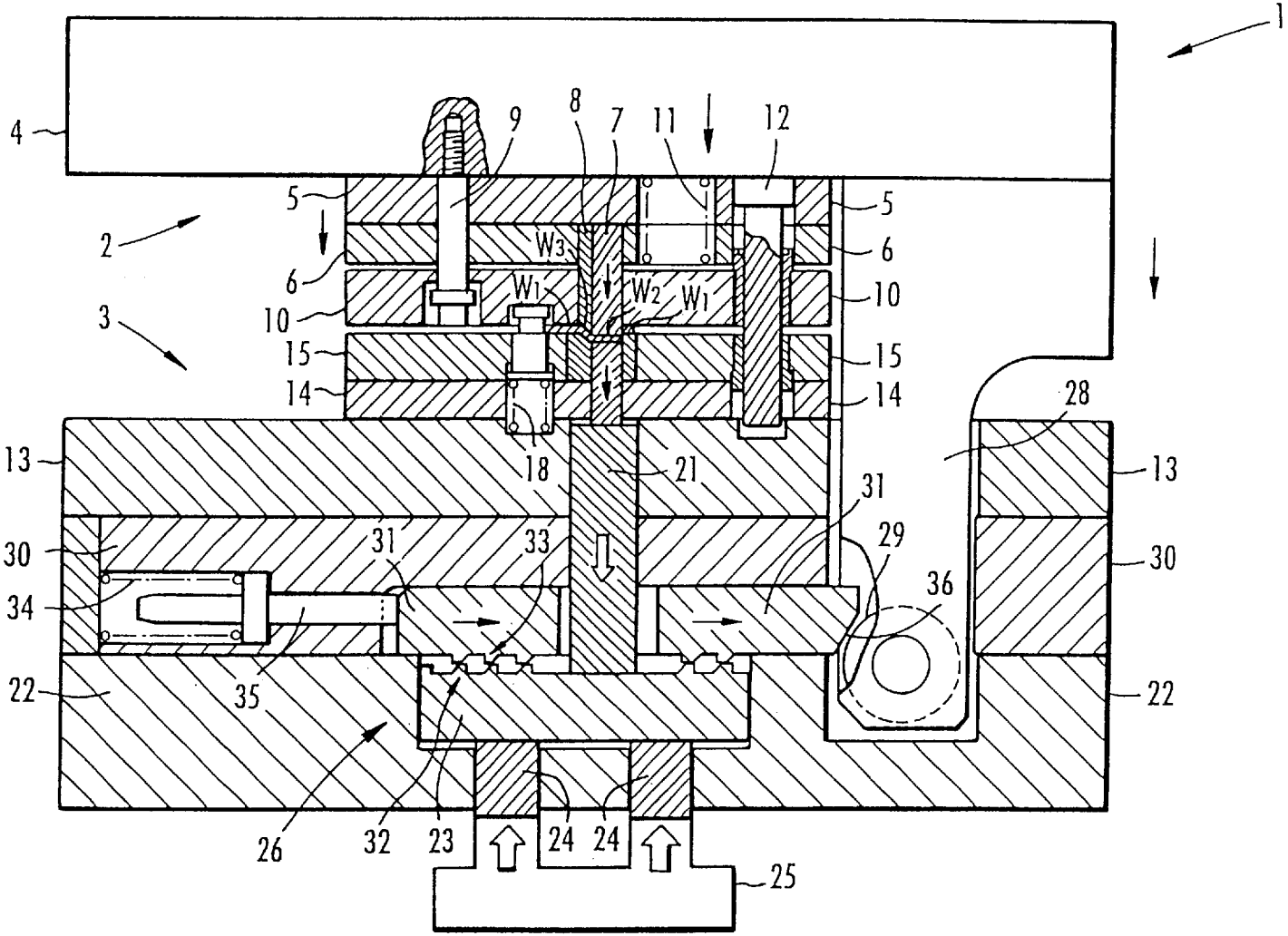
FIG. 2 is a vertical cross-sectional view showing a stage of operation of the workpiece blanking apparatus shown in FIG. 1.

When the upper die assembly 2 is further lowered toward the lower die assembly 3, the presser 19 on the pad 10 engages and depresses the guide lifter 17, and the plate W1 is resiliently pressed against the upper surface of the die 16 under the bias of the spring 11, as shown in FIG. 2. The blanking punch 7 and the joint forming punch 8 project downwardly from the lower surface of the pad 10, depressing the plate W1. The blanking punch 7 blanks the workpiece W2 out of the plate W1, and the joint forming punch 8 forms a joint W3 which interconnects the workpiece W2 and the plate When the blanking punch 7 depresses the workpiece W2, the workpiece W2 and the counterpunch 6 are lowered. The driver 28 is also lowered in unison with the upper die assembly 2, allowing the slider 31 to disengage from the cam roller 29. The slider 31 is now driven to the right under the bias of the spring 34. At this time, as shown in FIG. 5(*b*), the cam 33 smoothly slides from the lower surface 39 along the first slanted surface 38 onto the upper surface 37 where the cam 33 stops at rest. The cam 33 and the follower 32 are now held out of engagement with each other.

Then, the upper die assembly 2 starts moving upwardly. As shown in FIG. 3, the blanking punch 7 and the joint forming punch 8 ascend together away from the workpiece W2. At this time, the counterpunch 20 is released from the downward push of the blanking punch 7, but held in the lowered position by the holding means 26. Specifically, until the pad 10 is spaced from the workpiece W1 and elevated to its uppermost position, the slider 31 remains at rest under the bias of the spring 34, and the cam 33 is held on the upper surface 37 of the follower 32 as shown in FIG. 5(*b*). As shown in FIG. 3, the counterpunch 20 is prevented from ascending by the pusher 23. Since the counterpunch 20 is not lifted together with the blanking punch 7, the workpiece W2 is not pushed back toward the plate W1, and hence the outer edge of the workpiece W2 is prevented from contacting and being damaged by the plate W1. As a result, the workpiece W2 is blanked to a highly accurate shape.

Figure 4:
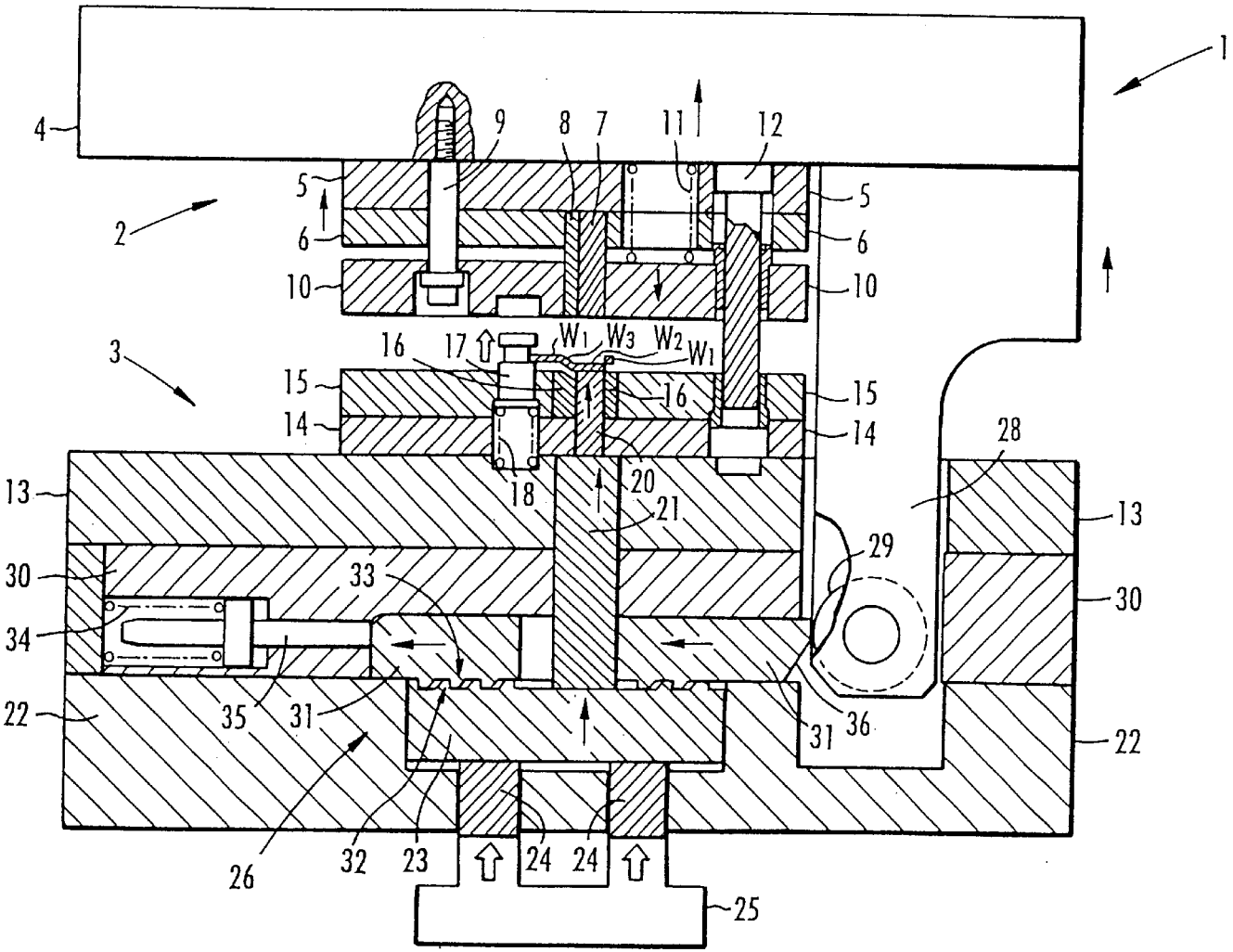
FIG. 4 is a vertical cross-sectional view showing a phase of operation, next to the phase of operation shown in FIG. 3, of the workpiece blanking apparatus.

As shown in FIG. 4, the pad 10 is spaced upwardly from the plate W1, releasing the plate W1, and also is spaced upwardly from the guide lifter 17, releasing the guide lifter 17. The guide lifter 17 is lifted under the bias of the spring 18, elevating the plate W1. Simultaneously, the cam roller 29 supported by the driver 28 which ascends with the upper die set 4 presses the slider 31 to the left against the bias of the spring 34. As shown in FIG. 5(*c*), the cam 33 smoothly slides from the upper surface 37 along the first slanted surface 38 onto the lower surface 39. At this time, the cam 33 smoothly moves from the upper surface 37 to the first slanted surface 38 along the portion of the first slanted surface 38 which is gradually curved downwardly from the upper end toward middle region at the progressively increasing angle. Then, the cam 33 smoothly moves and decelerates along the portion of the first slanted surface 38 which is gradually curved toward the horizontal plane from the middle region to lower end and smoothly blends into the lower surface 39, and reaches the lower surface 39. Thereafter, the cam 33 continuously slides along the lower surface 39 as shown in FIG. 5(*d*).

When the cam 33 slides along the first slanted surface 38 and the lower surface 39 of the follower 32, the slider 31 is sufficiently decelerated due to frictional engagement with the pusher 23 which is pressed against the slider 31 under the bias of the counterpunch urging means 25. Thereafter, as shown in FIG. 5(*e*), the cam 33 tends to slide up the second slanted surface 40 of the follower 32. However, the cam 33 is prevented from ascending along the second slanted surface 40 because of its relatively sharp angle of inclination, and returns to and is held at rest on the lower surface 39 as shown in FIG. 5(*a*). While the displacement of the cam 33 along the second slanted surface 40 is shown exaggerated in FIG. 5(*e*) for an easier understanding, the cam 33 actually slides up the second slanted surface 40 over a small distance, and can be braked smoothly without shocks by the second slanted surface 40.

When the cam 33 and the follower 32 are brought back into engagement with each other, as described above, the counterpunch 20 pushes the workpiece W2 above the die 16 as shown in FIG. 4.

Subsequently, the workpiece W2 that remains connected to the plate W1 and whose outer edge is not damaged is discharged from the workpiece blanking apparatus 1, and then severed from the plate W1 by a cutter or the like (not shown).

Figure 6:
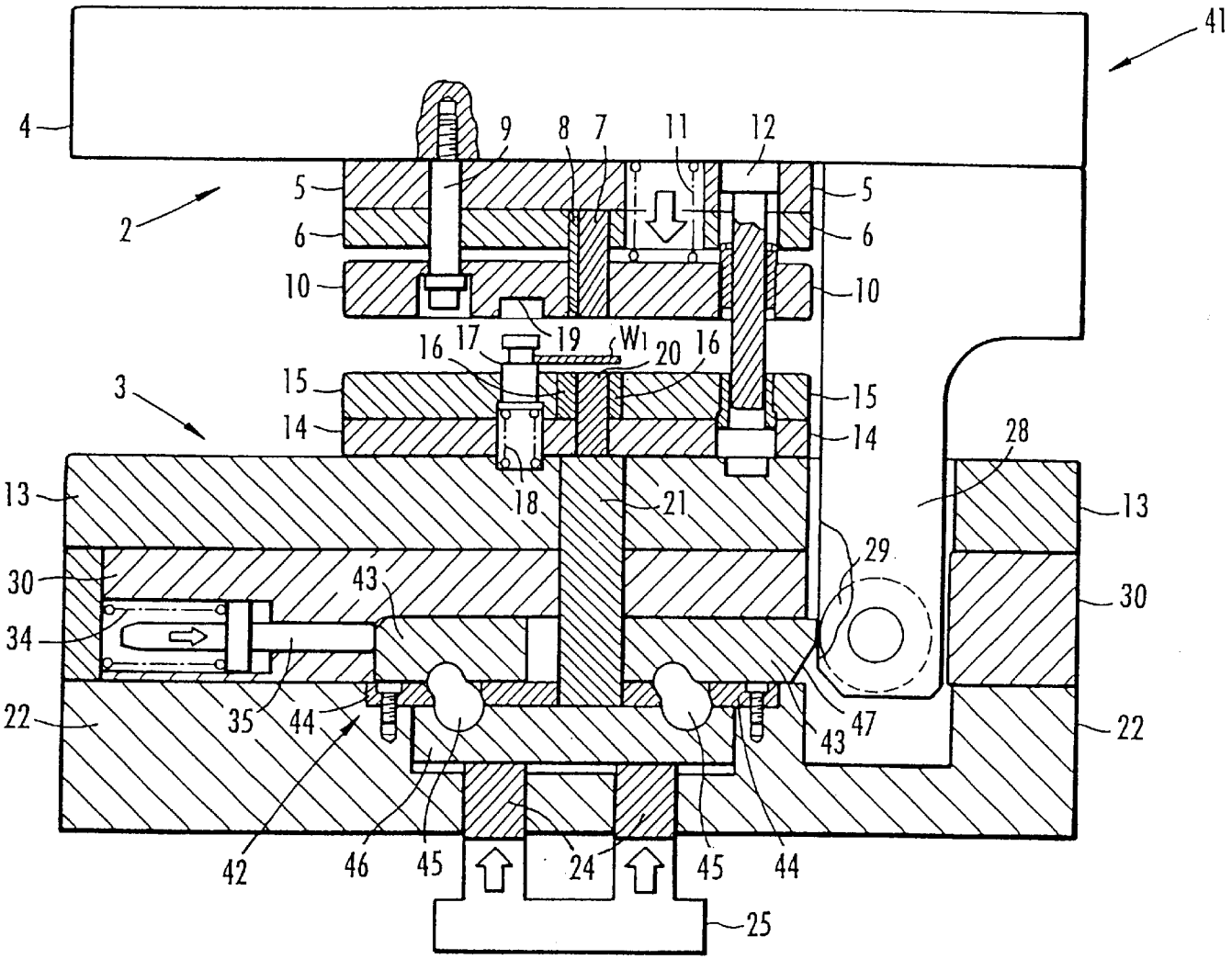
FIG. 6 is a vertical cross-sectional view of a workpiece blanking apparatus according to a second embodiment of the present invention.

A workpiece blanking apparatus according to a second embodiment of the present invention will be described below with reference to FIGS. 6 through 9. As shown in FIG. 6, the workpiece blanking apparatus, generally denoted by 41, according to the second embodiment operates in the same manner as the workpiece blanking apparatus 1 according to the first embodiment, but has a holding means 42 different in structure from the holding means 26 of the workpiece blanking apparatus 1. In FIGS. 6 through 9, those parts of the workpiece blanking apparatus 41 which are identical to those of the workpiece blanking apparatus 1 are denoted by identical reference characters, and will not be described in detail below.

As shown in FIG. 6, the holding means 42 of the workpiece blanking apparatus 41 comprises a slider 43 which is horizontally movably housed in the spacer plate 30 that is fixedly disposed between the lower die set 13 and the set plate 22, a cam retainer 44 fixed to the set plate 22, and a pair of cams 45 supported by the cam retainer 44. The cams 45 supported by the cam retainer 44 are tiltably disposed between a slider 43 and a pusher 46.

The pusher 46 is connected to the lower end of the first pressure pin 21 and vertically movably supported in the set plate 22. The pusher 46 is normally urged to move upwardly by the pair of second pressure pins 24 connected to the counterpunch urging means 25 such as a spring, a cylinder or the like (not shown). The biasing force of the counterpunch urging means 25 is transmitted from the pusher 46 to the counterpunch 20 by the first pressure pin 21.

The cams 45 have substantially lower half portions of larger diameter that are angularly movably held in engagement with the pusher 46, and substantially upper half portions of smaller diameter that are angularly movably held in engagement with the slider 43. The cams 45 can selectively be brought into a tilted position shown in FIG. 6 and an erected position shown in FIG. 7.

The slider 43 is normally urged by the pusher pin 35 biased by the spring 34 positioned on one side (left side in FIG. 6) of the slider 43, to move away from the spring 34 (to the right in FIG. 6). The slider 43 has an inclined surface 47 on an end (right end in FIG. 6) thereof remote from the pusher pin 35. The inclined surface 47 is held against the cam roller 29 rotatably supported on the lower end of the driver 28. The spring 34, the pusher pin 35, the driver 28, and the cam roller 29 jointly make up a cam driving means in the second embodiment.

The cams 45 of the holding means 42 provide a so-called toggle mechanism. Specifically, when in the tilted position shown in FIG. 6, the cams 45 are pressed against the slider 43 under an upward biasing force that is applied from the counterpunch urging means 25 via the second pressure pin 24 to the pusher 46. The cams 45 are maintained in the tilted position for thereby preventing the slider 43 from moving. When the pusher 46 is lowered, as described in detail later on, the cams 45 in the tilted position are released from the push against the slider 43 and can be angularly moved. The cams 45 are now brought into the erected position in response to movement of the slider 43 caused by the pusher pin 31 under the bias of the spring 30. When the upward biasing force from the pusher 46 is applied to the cams 45 in the erected position, the cams 45 in the erected position (actually slightly tilted in the direction in which it is pushed by the spring 30 and the pusher pin 31) prevent the slider 43 from moving. When the cam roller 34 is elevated, the cam roller 34 rollingly contacts the inclined surface 47 of the slider 43 and moves the slider 43 against the bias of the spring 30. The cams 45 is tilted from the erected position to the tilted position in the direction in which the slider 43 is moved, and then maintained in the tilted position shown in FIG. 6.

Operation of the workpiece blanking apparatus 41 according to the second embodiment will be described below. As shown in FIG. 6, the plate W1 is placed between the blanking punch 7 and the die 16 and supported at one side by the guide lifter 17. Then, the upper die assembly 2 starts being lowered toward the lower die assembly 3. At this time, the cams 45 are in the tilted position, and the biasing force from the counterpunch biasing means 25 is applied through the pusher 46 to the counter punch 20. Since the cams 45 are in the tilted position, the slider 43 is prevented from moving against the bias of the spring 30 by the toggle mechanism.

Figure 7:
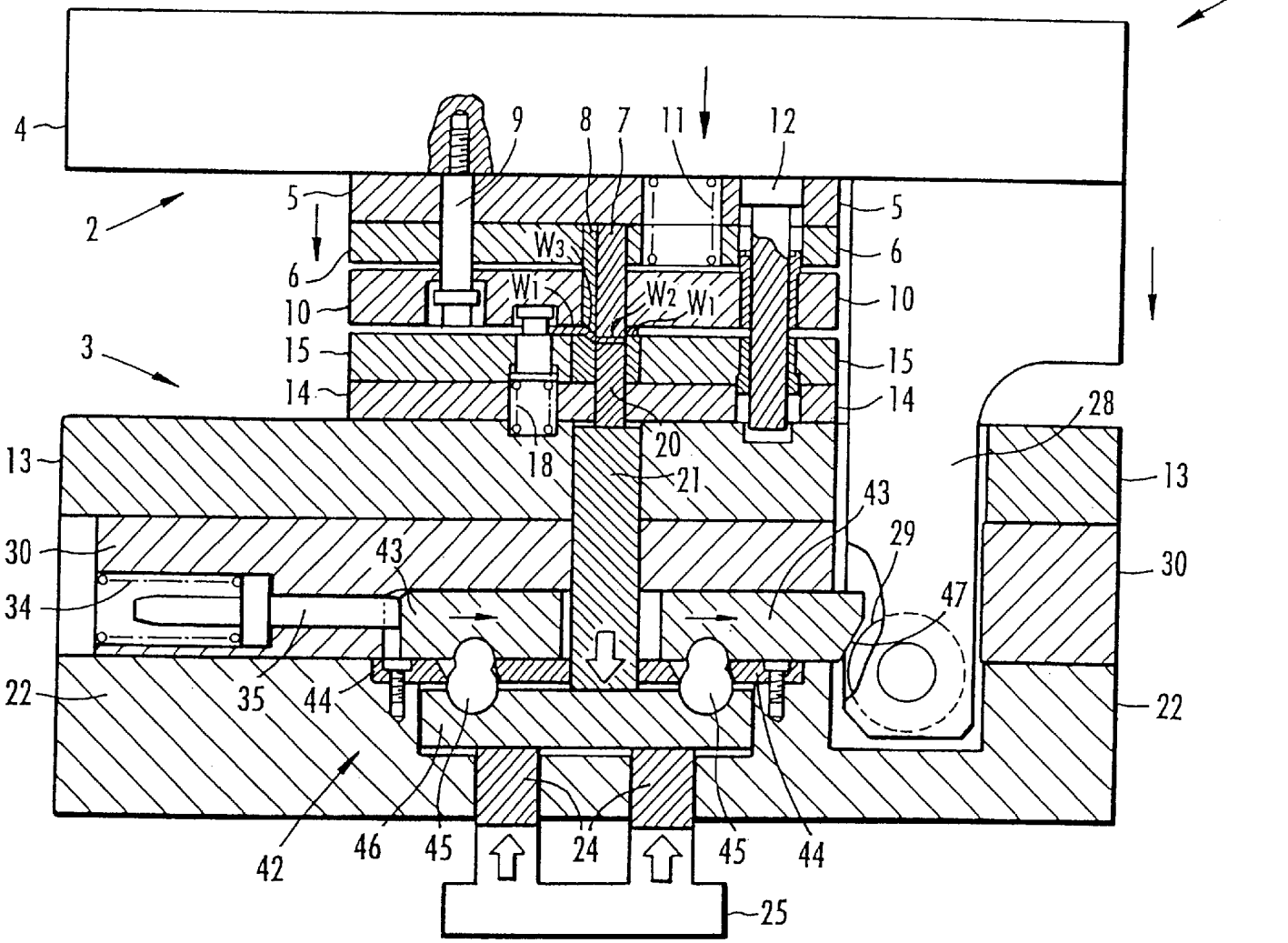
FIG. 7 is a vertical cross-sectional view showing a stage of operation of the workpiece blanking apparatus shown in FIG. 6.

When the upper die assembly 2 is further lowered toward the lower die assembly 3, the pad 10 depresses the guide lifter 17, engages the plate W1, and presses the plate W1 against the upper surface of the die plate 15, as shown in FIG. 7. The plate W1 is resiliently pressed against the upper surface of the die 16 under the bias of the spring 11. The blanking punch 7 that has descended with the pad 10 projects downwardly from the lower surface of the pad 10, depressing the plate W1. The blanking punch 7 blanks the workpiece W2 out of the plate W1. At this time, the blanking punch 7 causes the workpiece W2 to depress the counterpunch 20. The depressed counterpunch 20 causes the first pressure pin 21 to lower the pusher 46. When the pusher 46 is lowered, the cams 45 are released from the push from the pusher 46, and release the slider 43. The slider 43 is moved to the right under the bias of the spring 30, turning the cams 45 into the erected position.

At this moment, the workpiece W2 is blanked out of the plate W1 by the blanking punch 7 while remaining joined to the plate W1 by the joint W3 formed by the joint forming punch 8. Then, the upper die assembly 2 starts moving upwardly.

Figure 8:
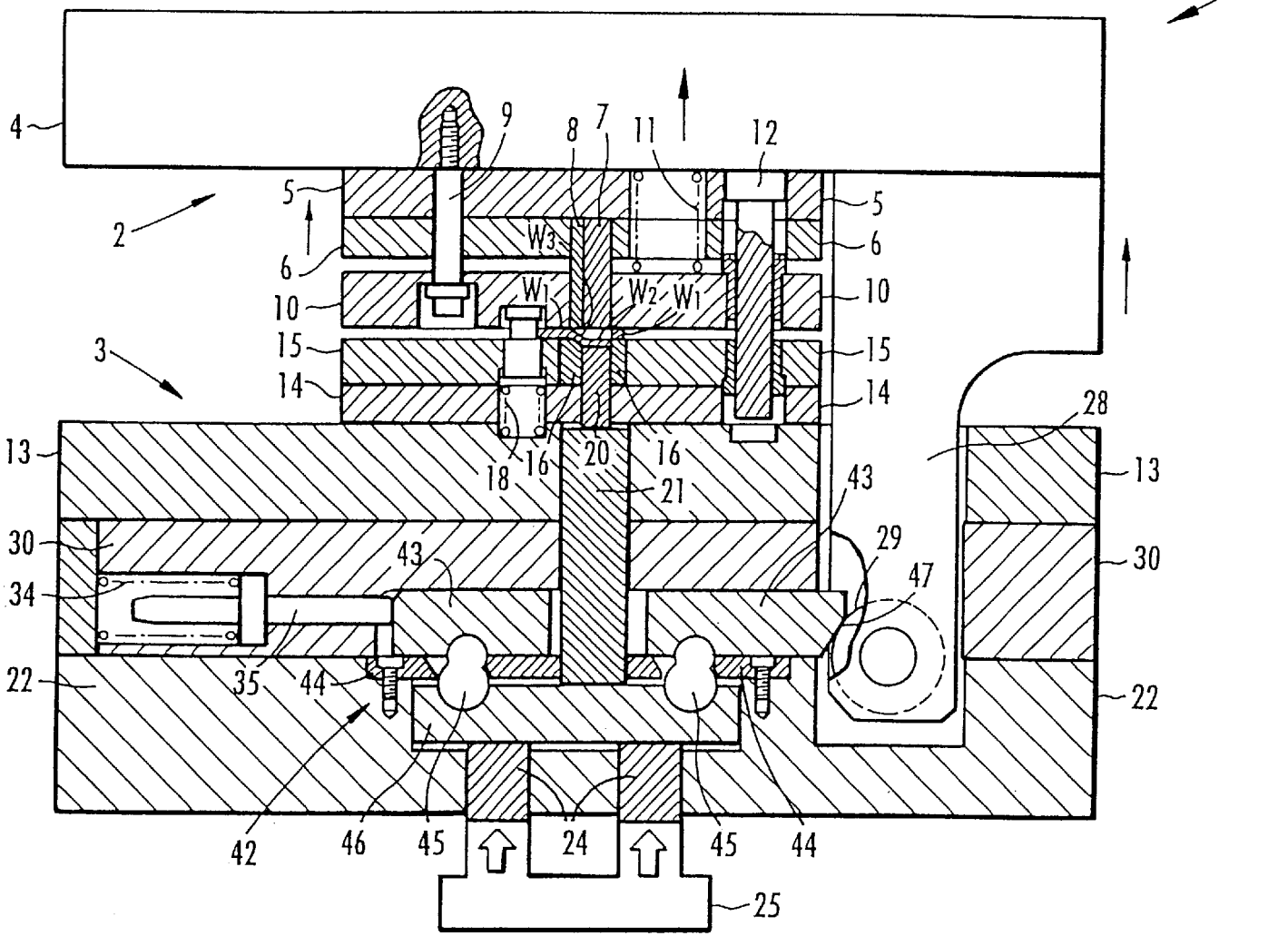
FIG. 8 is a vertical cross-sectional view showing a phase of operation, next to the stage of operation shown in FIG. 7, of the workpiece blanking apparatus.

As shown in FIG. 8, when the upper die assembly 2 elevated, the blanking punch 7 is first raised, releasing the counterpunch 20 from the downward push. The counterpunch urging means 25 tends to push the pusher 46 upwardly. However, the pusher 46 is prevented from moving upwardly because the cams 45 are in the erected position. Therefore, the biasing force from the counterpunch urging means 25 is not transmitted to the counterpunch 20, which is thus held in the lowered position.

As a result, the counterpunch 20 does not ascend in unison with the blanking punch 7, and does not lift the workpiece W2. Since the blanking punch 7 is lifted during this time, the blanking punch 7 is spaced from the workpiece W2. Because the counterpunch 20 does not ascend in unison with the blanking punch 7, the workpiece W2 is not pushed back to the plate W1, and hence the outer edge of the workpiece W2 is prevented from contacting and being damaged by the plate W1. As a result, the workpiece W2 is blanked to a highly accurate shape.

Figure 9:
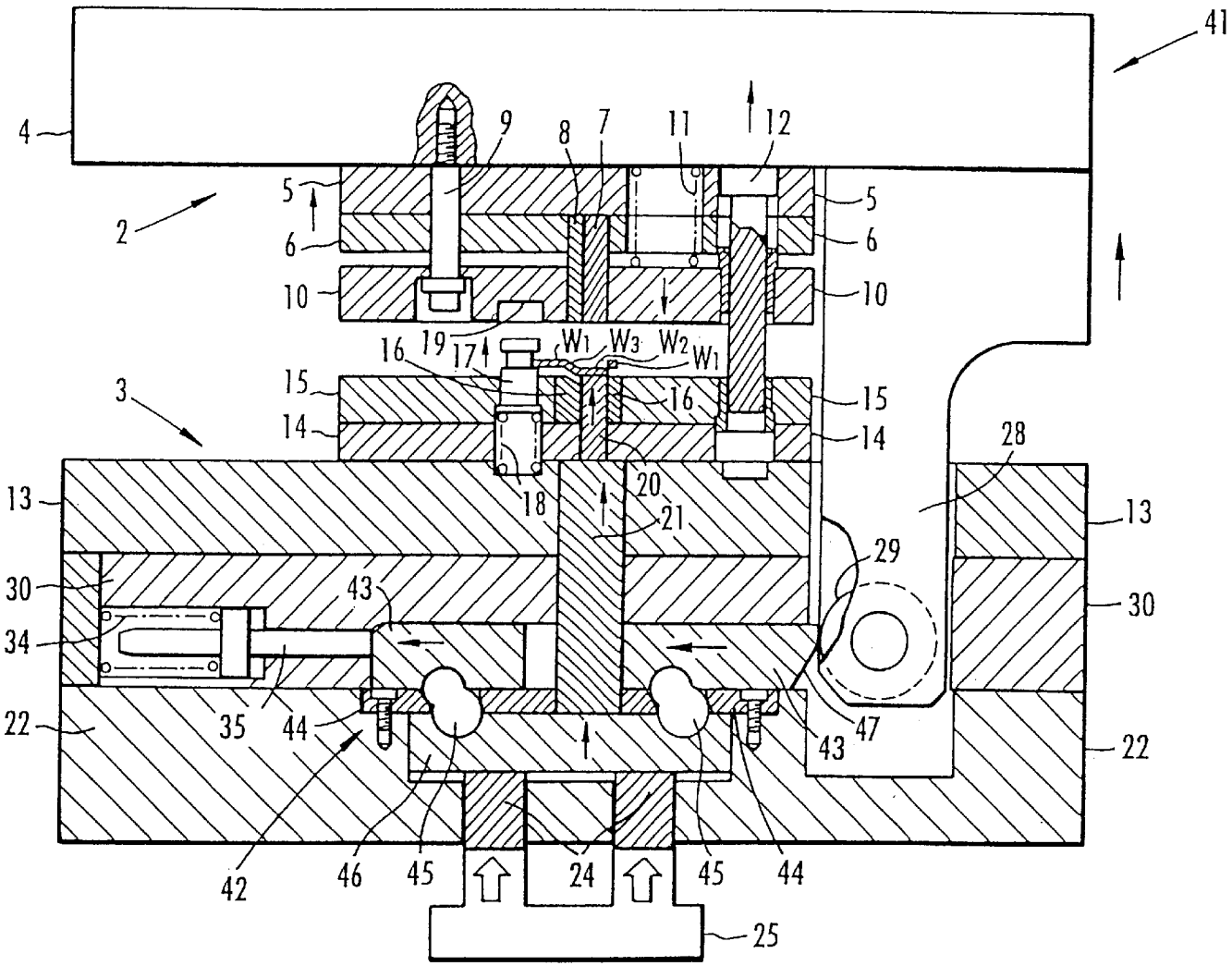
FIG. 9 is a vertical cross-sectional view showing a phase of operation, next to the phase of operation shown in FIG. 8, of the workpiece blanking apparatus.

Upon continued ascent of the upper die assembly 2, as shown in FIG. 9, the pad 10 is spaced upwardly from the plate W1, releasing the plate W1, and also is spaced upwardly from the guide lifter 17, releasing the guide lifter 17. The guide lifter 17 is lifted under the bias of the spring 18, elevating the plate W1. Simultaneously, the counterpunch 20 is elevated to push the workpiece W2 out of the die 16 in synchronism with the upward movement of the driver 28. Specifically, when the driver 28 is lifted, the cam roller 29 engages the inclined surface 47 of the slider 43 and pushes the slider 43 to the left. As the slider 43 is displaced to the left, the cams 45 are tilted to release the pusher 46. With the cams 45 in the tilted position, the pusher 46 transmits the biasing force from the counterpunch urging means 25 to the counterpunch 20. The counterpunch 20 is now lifted resiliently to lift the workpiece W2 as shown in FIG. 9.

Thereafter, the workpiece W2 that remains connected to the plate W1 and whose outer edge is not damaged is discharged from the workpiece blanking apparatus 41, and then severed from the plate W1 by a cutter or the like (not shown).

Although certain preferred embodiments of the present invention have been shown and described in detail, it should be understood that various changes and modifications may be made therein without departing from the scope of the appended claims.

What is claimed is:

1. A workpiece blanking apparatus comprising:

a die;

a pad for holding a plate of metal on said die;

a blanking punch for depressing the plate on said die downwardly of the die to blank a workpiece out of the plate;

a counterpunch vertically movably disposed in said die in confronting relationship to said blanking punch and movable downwardly with the workpiece blanked by said blanking punch;

counterpunch urging means for normally urging said counterpunch upwardly; and holding means for holding said counterpunch in a lowered position after the workpiece is blanked by said blanking punch until said blanking punch is spaced from the workpiece, said pad is spaced from the plate, and said blanking punch and said pad are lifted to a predetermined position, and for releasing said counterpunch in said lowered position and allowing said counterpunch to displace said workpiece out of said die when said blanking punch and said pad are lifted to said predetermined position, wherein said holding means comprises:

a pusher vertically movably disposed below said die for transmitting a biasing force from said counterpunch urging means to said counterpunch;

a concave follower integrally mounted on an upper surface of said pusher;

a slider disposed for movement along the upper surface of said pusher in a horizontal direction transverse to said counterpunch;

a cam integrally projecting from a lower surface of said slider and movable into and out of engagement with said follower, for preventing said pusher from ascending upon movement into engagement with said follower and allowing said pusher to ascend upon movement out of engagement with said follower; and slider driving means for moving said slider horizontally in a direction to bring said cam out of engagement with said follower when said pusher is lowered in response to downward movement of said counterpunch depressed by said blanking punch, and for moving said slider horizontally in a direction to bring said cam into engagement with said follower when said blanking punch and said pad are lifted to said predetermined position.

2. A workpiece blanking apparatus according to claim 1, wherein said concave follower comprises:

a horizontal upper surface for engaging said cam when said cam is out of engagement with said follower;

a first slanted surface inclined continuously obliquely downwardly from said horizontal upper surface, for guiding said cam to slide from said horizontal upper surface;

a horizontal lower surface contiguous to said first slanted surface for allowing said cam to slide horizontally thereon; and a second slanted surface inclined continuously obliquely upwardly from said horizontal lower surface in confronting relationship to said first slanted surface at a progressively increasing angle, for limiting sliding movement of said cam from said horizontal lower surface.

3. A workpiece blanking apparatus according to claim 2, wherein said first slanted surface has an angle progressively increasing downwardly from an upper end thereof which is contiguous to said horizontal upper surface, and progressively decreasing downwardly toward a lower end thereof so as to allow the first slanted surface to blend into said horizontal lower surface.

4. A workpiece blanking apparatus comprising:

a die;

a pad for holding a plate of metal on said die;

a blanking punch for depressing the plate on said die downwardly of the die to blank a workpiece out of the plate;

a counterpunch vertically movably disposed in said die in confronting relationship to said blanking punch and movable downwardly with the workpiece blanked by said blanking punch;

counterpunch urging means for normally urging said counterpunch upwardly; and holding means for holding said counterpunch in a lowered position after the workpiece is blanked by said blanking punch until said blanking punch is spaced from the workpiece, said pad is spaced from the plate, and said blanking punch and said pad are lifted to a predetermined position, and for releasing said counterpunch in said lowered position and allowing said counterpunch to displace said workpiece out of said die when said blanking punch and said pad are lifted to said predetermined position, wherein said holding means comprises:

a pusher vertically movably disposed below said die for transmitting a biasing force from said counterpunch urging means to said counterpunch;

a cam tiltably disposed between said pusher and said die, for preventing said pusher from ascending upon angular movement into an erected position and allowing said pusher to ascend upon angular movement into a tilted position; and cam driving means for angularly moving said cam into the erected position when said pusher is lowered in response to downward movement of said counterpunch depressed by said blanking punch, and for angularly moving said cam into the tilted position when said blanking punch and said pad are lifted to said predetermined position.

5. A workpiece blanking apparatus according to claim 4, wherein said holding means comprises a slider disposed for movement along an upper surface of said pusher in a horizontal direction transverse to said counterpunch, said cam driving means comprising means for horizontally moving said slider in a direction to bring said cam into the erected position when said pusher is lowered in response to downward movement of said counterpunch depressed by said blanking punch, and for horizontally moving said slider in a direction to bring said cam into the tilted position when said blanking punch and said pad are lifted to said predetermined position.

6. A workpiece blanking apparatus comprising:

a die for supporting a plate of metal thereon;

a blanking punch for depressing the plate downwardly of said die to blank a workpiece out of the plate;

a counter punch vertically movably disposed in said die in confronting relationship to said blanking punch and movable downwardly with the workpiece blanked by said blanking punch;

a pusher vertically movably disposed below said counter punch, said pusher providing a force directing said counter punch toward said blanking punch; and a blocking device engaging said pusher and movable between a first position and a second position, said blocking device permitting said pusher to move said counter punch toward said blanking punch when said blocking device is in said first position thereby permitting said counter punch to displace the blanked workpiece out of said die, and said blocking device preventing said pusher from moving said counter punch toward said blanking punch when said blocking device is in said second position thereby preventing said counter punch from displacing the blanked workpiece out of said die at a lowered position wherein said blocking device comprises a slider disposed for movement in a horizontal direction along an upper surface of said pusher, wherein said blocking device has a cam projecting from a lower surface thereof, and said pusher has a follower located on said upper surface thereof which is engagable with said cam of said blocking device, and wherein said follower comprises:

a horizontal upper surface for engaging said cam when said cam is out of engagement with said follower and said slider is in said first position;

a first slanted surface inclined continuously obliquely downwardly from said horizontal upper surface, for guiding said cam to slide from said horizontal upper surface;

a horizontal lower surface contiguous to said first slanted surface for allowing said cam to slide horizontally thereon and said slider is in said second position; and a second slated surface inclined continuously obliquely upwardly from said horizontal lower surface in confronting relationship to said first slanted surface at a progressively increasing angle, for limiting sliding movement of said cam from said horizontal lower surface.

7. The workpiece blanking device according to claim 6, further comprising a driver for moving said slider between said first position and said second position.

8. The workpiece blanking device according to claim 6, wherein said first slanted surface has an angle progressively increasing downwardly from an upper end thereof which is contiguous to said horizontal upper surface, and progressively decreasing downwardly toward a lower end thereof so as to allow the first slanted surface to blend into said horizontal lower surface.

9. A workpiece blanking apparatus comprising:

a die for supporting a plate of metal thereon;

a blanking punch for depressing the plate downwardly of said die to blank a workpiece out of the plate;

a counter punch vertically movably disposed in said die in confronting relationship to said blanking punch and movable downwardly with the workpiece blanked by said blanking punch;

a pusher vertically movably disposed below said counter punch, said pusher providing a force directing said counter punch toward said blanking punch; and a blocking device engaging said pusher and movable between a first position and a second position, said blocking device permitting said pusher to move said counter punch toward said blanking punch when said blocking device is in first position thereby permitting said counter punch to displace the blanked workpiece out of said die, and said blocking device preventing said pusher from moving said counter punch toward said blanking punch when said blocking device is in said second position thereby preventing said counter punch from displacing the blanked workpiece out of said die at a lowered position, wherein said blocking device comprises a slider disposed for movement in a horizontal direction spaced above an upper surface of said pusher.

10. The workpiece blanking device according to claim 9, wherein said blocking device further comprises at least one cam disposed between a lower surface of said slider and said upper surface of said pusher.

11. The workpiece blanking device according to claim 10, wherein said cam is pivotable between a first orientation when said slider is in said first position, and a second orientation when said slider is in said second position.

12. The workpiece blanking device according to claim 11, wherein a spacing between said lower surface of said slider and said upper of said pusher is greater when said cam is in said second orientation.

13. The workpiece blanking device according to claim 9, further comprising a driver for moving said slider between said first position and said second position.

* * * * *